US005427719A

United States Patent [19]

Oshima

[11] Patent Number: 5,427,719

[45] Date of Patent: Jun. 27, 1995

[54] MAIN NOZZLE FOR CARBURETOR

[75] Inventor: Machiko Oshima, Tokyo, Japan

[73] Assignee: Kabushiki Kaisha Kenso, Tokyo, Japan

[21] Appl. No.: 187,078

[22] Filed: Jan. 27, 1994

[30] Foreign Application Priority Data

Feb. 19, 1993 [JP] Japan ..... 5-053140

[51] Int. Cl.[6] ..... F02M 9/06

[52] U.S. Cl. ..... 261/44.3; 261/DIG. 39

[58] Field of Search ..... 261/44.3, DIG. 39

[56] References Cited

U.S. PATENT DOCUMENTS 5,021,198 6/1991 Bostelmann ..... 261/44.3
5,300,259 4/1994 Tashiro ..... 261/44.3

FOREIGN PATENT DOCUMENTS 0096768 5/1987 Japan ..... 261/44.3
173038 12/1921 United Kingdom ..... 261/44.3
488462 7/1938 United Kingdom ..... 261/44.3

*Primary Examiner*—Tim Miles
*Attorney, Agent, or Firm*—Sughrue, Mion, Zinn, Macpeak & Seas

[57] ABSTRACT

A carbutetor having an intake pass, an axially movable throttle valve, a main nozzle, a main jet fixedly disposed on the lower end of the main nozzle having an axial channel, a conical surface and a planar surface. The main jet comprises a plurality of downwardly directed oblique holes formed on the conical surface and extending to the axial channel. The surface of the oblique holes is made of a rough surface in order to reduce the boundary layer of fuel flowing through the oblique holes, thereby creating a smooth flow of fuel and improving fuel efficiency.

10 Claims, 2 Drawing Sheets

MAIN NOZZLE FOR CARBURETOR

BACKGROUND OF THE INVENTION

1. Field of the Invention

This invention relates to the improvement of a carburetor in engines using gasoline, light oil or the like as a fuel for, for example, automobiles,motorcycles and the like.

2. The Background Art

A known structure of such carburetor is, for example, as shown in FIG. 1. Such carburetor is provided with a throttle valve 6 which is moved in the direction crossing with an intake pass 2 in communication with an engine so as to form a variable venturi portion 5 in the intake pass 2. There is a main nozzle 3 for controlling fuel inflow in a manner to cross with the intake pass 2 as with the valve 6. The carburetor is provided with a jet needle 7 which has a taper portion gradually decreasing in diameter toward its head, and whose base end is mounted to said throttle valve, and whose tapering head portion is inserted into the main nozzle 3.

With the axial movement of the throttle valve 6, the gap between the main nozzle 3 and the jet needle 7 is allowed to change, whereby a fuel proportional to the intake flow flowing through the venturi portion is taken in from the main nozzle 3 so as to control the air-fuel ratio.

Known head configurations of the jet needle 7 include a needle configuration in which its body tapers toward its head at a certain taper angle, and a conical configuration in which its body becomes conical at its head.

A main jet 13 is threadingly connected to the lower end of the main nozzle 3. The bottom of the main jet is flat with a single hole therein, and is orthogonal to the outside walls.

A carburator assembly 1 is formed with an intake pass 2 communicating with an engine G, and provided on the lower side of the intake pass 2 is a main nozzle 3 communicating with the intake pass 2. Formed on the upper side of the intake pass 2 is a throttle mechanism 4, and provided slidably in the throttle mechanism 4 is a throttle valve 6 which is moved in the direction crossing with the intake pass 2 so as to form a variable venturi portion 5 in the intake pass 2.

Mounted on the lower end of the throttle valve 6 is a jet needle valve 7, and connected threadingly to the head of the jet needle valve 7 is a main jet 13. The throttle valve 6 is urged by a spring 8, so that the movement of the valve can be adjusted by a throttle lever (not shown).

Formed on the lower side of the intake pass 2 is a fuel tank 9, into which a fuel is supplied through a fuel supply port 10. Provided in the fuel tank 9 is a float 11, and the fuel supply into the fuel tank 9 is controlled by a control valve 12 connected to the float 11. Arrows A, E and F indicate the flow of intake air,mixed gas and fuel, respectively. The fuel sucked by a negative pressure, occurring by the intake air A flowing from an upstream side P1 to a downstream side P2 of the intake pass 2, is first roughly measured by the main jet 13.

SUMMARY OF THE INVENTION

An object of the invention is to provide a carburetor capable of reducing the area of the boundary layer in the pass of fluid such as fuel or air, or mixed gas, of improving fuel efficiency by optimizing air-fuel ratio and eliminating knock and short breath, and of making design and setting easy so as to improve usability.

In a carburetor in which the jet needle which has a taper portion gradually decreasing in diameter toward its head is inserted in the main nozzle which is provided crossing with an intake pass and provided with the main jet at its lower end, and with the axial movement of the throttle valve ,the gap between the main nozzle and the jet needle is allowed to change so as to control the flow of a fuel taken in from the head of the jet needle;the lower end of the main jet fixedly provided on the head of said main nozzle comprises a conical surface and a planar portion;the main jet has a plurality of downward oblique holes boredly provided on the conical surface in such a manner that the holes are equally spaced on the circumference at an inclined angle 30° to 90° to axial direction; and the internal surface of said holes is made a rough surface.

The internal wall surface of fuel intake holes following said plurality of downward oblique holes of the main nozzle is also provided with the rough surface. An upward oblique hole other than the downward oblique holes is further provided.

According to this invention, a fuel flows smoothly, through the plurality of downward oblique holes or the upward oblique hole of the conical surface on the lower end of the main jet fixedly provided on the head of the main nozzle, into the nozzle. In the flow of the fuel, the presence of the rough surface on a boundary layer occurring between the wall surface of the fuel supply pass and the fuel causes the area of the boundary layer to be decreased. That is, the fuel enters dents on the rough surface, on which the flow causes a slippage between fuel layers, whereby a fluid deceleration is not present on the portion in contact with the wall. This causes the flow of the fuel to closely resemble an ideal fluid flow, the fuel supply for producing mixing gas to become smooth, and the air-fuel ratio to be optimized.

DETAILED DESCRIPTION OF THE PREFERRED EMBODIMENTS

Figure 2:
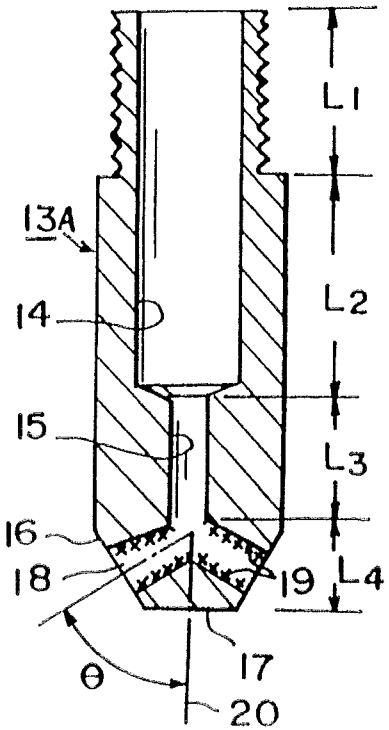
FIG. 2 is a main jet of the invention.
Figure 1:
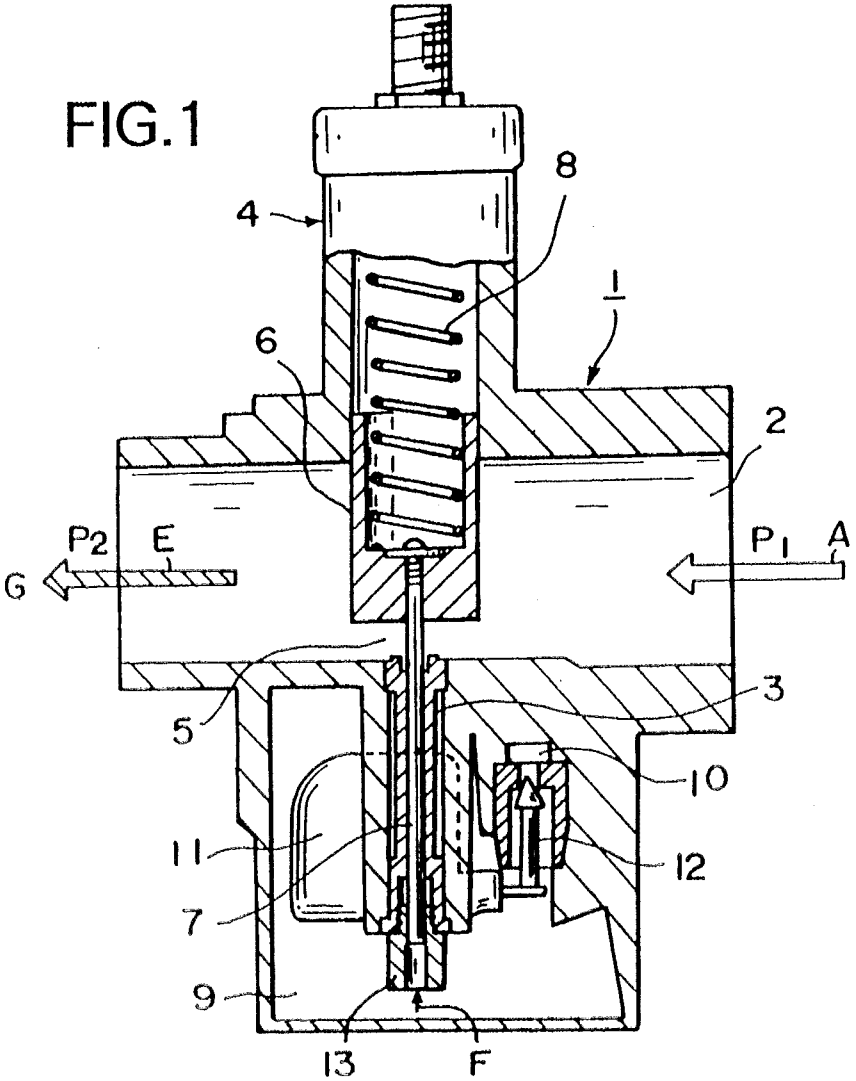
FIG. 1 is section view of a carburator embodying the environment for the invention.

The invention relates to the composition of the main jet 13 in a conventional carburator as seen in FIG. 1. FIG. 2 is a section view of the main jet 13A structured in accordance with the invention. Along the axial length of the main jet 13 are a threaded portion L1, for joining to the main nozzle 3, a first intermediate portion L2 having large diameter hole 14, a second intermediate portion L3 having small diameter hole 15 and portion L4 comprising the head. In the main jet 13A, as shown in FIG. 2, the head of the main jet body has a planar portion 17, and said planar portion 17 is connected through a conical surface 16 to the body.

Provided in the body 14 is a hole for inserting the jet needle.

The hole comprises a large diameter hole 14 and a small diameter hole 15 following the hole 14. The head portion of the small diameter hole 15 has a plurality of downward oblique holes 18 boredly provided on the conical surface 16 in such a manner that the holes are equally spaced on the circumference at an inclined angle $\theta$ of 30° to 90° to a center line 20 of the main jet 13A. The number of the downward oblique holes 18 is preferably about three.

Provided on the internal surface of the downward oblique holes 18 is a rough surface 19 having micro irregularities formed by blast treatment. A surface roughing treatment is also preferably applied to the internal surface of the large diameter hole 14 and the small diameter hole 15 communicating with the downward oblique holes 18 as shown in FIG. 4.

Figure 3:
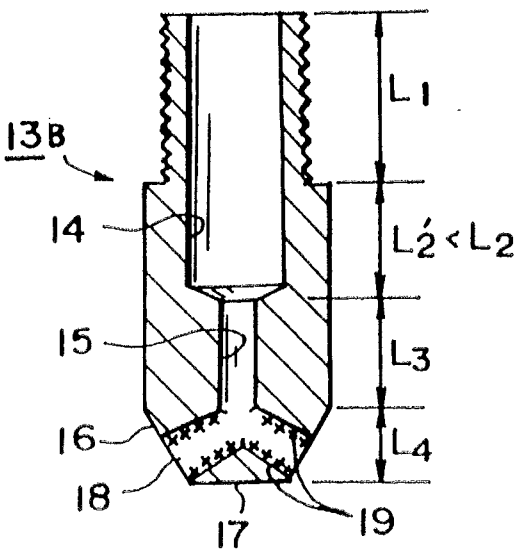
FIG. 3 is another embodiment of the main jet.

A main jet 13B of FIG. 3 is another embodiment, in which the composition of the vicinity of the downward oblique holes 18 is just the same as that of FIG. 2. However a length L2' of the first intermediate portion is made shorter.

Therefore, the air-fuel ratio at the beginning of opening the throttle lever from its full shutting can be made smaller, as the tapering head portion is more deeply inserted into the main nozzle.

Figure 4:
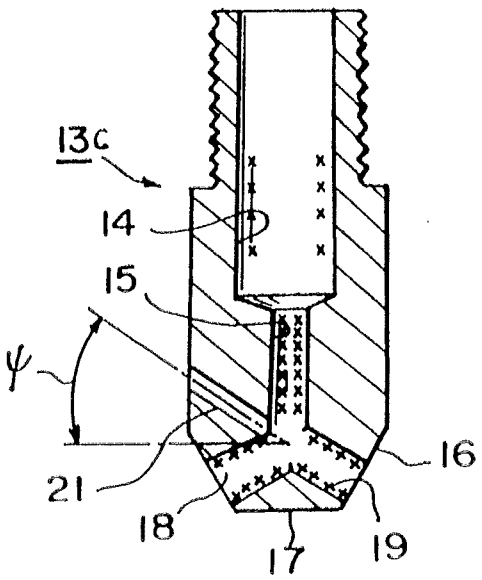
FIG. 4 is still another embodiment of the main jet.

A main jet 13C of FIG. 4 is still another embodiment, in which in addition to the downward oblique holes 18, an upward oblique hole 21 is provided on the lower end of the small diameter hole 15 at an obliquely upward angle $\psi$ of 30° to 60°. As with the first embodiment, the rough surface 19 is provided on the upward oblique hole 21. In this manner, the providing of the downward oblique holes 18 and the upward oblique hole 21 allows a smoother fuel supply.

As described above, provided on the head of the main jet 13A–13C are the plurality of downward oblique holes 18 equally spaced on the circumference or the upward oblique hole 21 in addition to the downward oblique holes 18, and provided on these oblique holes is the rough surface 19 formed by blast treatment. In this manner, the providing of the rough surface 19 causes the wall surface to be composed of the dints by blast shot and protrusions formed between dints. When the fuel flows in contact with the wall surface of the main jet, a boundary layer in which the fuel velocity is decelerated by friction resistance is present in the protrusions, while in the dints, the fuel flow experiences a slippage between the fuel retained in the dints and the fuel flowing on the external side of the dints. Due to this slippage between fuels, the condition of the fuel velocity becomes similar to that of an ideal fluid.

Accordingly, compared with a conventional, smooth surface pass having no rough surface 19, the thickness of the boundary layer along the wall surface is significantly reduced. As a result, even where the gap is small, the fuel supply is subject to a little decelerating action of the boundary layer, and thus is improved.

This allows an air-fuel ratio leading to the increase in output to be obtained.

The fuel is sucked from the plurality of downward oblique holes 18 equally spaced on the circumference or from the upward oblique hole 21 in which the rough surface 19 is provided, whereby the effect of the rough surface 19 on the individual oblique holes is increased; the fuel supply is extremely improved; and the air-fuel ratio leading to the increase in output is allowed.

Further, the rough surface 19 causes the pass resistance by air and fuel to be reduced, and the optimization of the air-fuel ratio allows horsepower to be improved and short breath to be eliminated. The fuel flow can be proportionally controlled, thereby making design and setting easy, and thus improving usability. Still further, the improvement of the fuel supply or intake allows the device to be made compact, and the weight and manufacturing cost to be reduced.

What is claimed is:

1. A carburetor having an intake pass, an axially moveable throttle valve for forming a variable venturi in said intake pass, a main nozzle disposed at said intake pass and having a channel therein extending in an axial direction between said intake pass and a lower end, a jet needle having a longitudinal portion disposed between a head at one end and a base at the other end, said base being mounted to and moveable by said throttle valve, said longitudinal portion comprising a taper portion gradually decreasing in diameter toward said head and having said tapering and head portion inserted into said main nozzle channel, a main jet fixedly disposed at said main nozzle lower end and having an axial channel contiguous with said main nozzle channel, wherein with axial movement of said throttle valve, a gap between said main nozzle and said jet needle being changeable so as to control the flow of a fuel taken in from said head of the jet needle; said main nozzle for the carburetor being characterized in that the lower end of the main jet fixedly provided on said main nozzle comprises a conical surface and a planar surface, said surfaces defining a truncated cone, said main jet comprises a plurality of downwardly directed oblique holes formed in said conical surface and extending to said main axial channel for fuel communication therewith.

2. A carburetor as set forth in claim 1, wherein the internal wall surface of at least a portion of said axial channel in said main nozzle is provided with a rough surface.

3. A carburetor as set forth in claim 1, further comprising an upward oblique hole in fuel-communication with said axial channel.

4. carburetor as set forth in claim 1, wherein said main jet planar surface has no holes.

5. The carburetor as set forth in claim 1, wherein said holes are equally spaced on the circumference at an inclined angle 30° to 90° to said axial direction.

6. The carburetor as set forth in claim 5, wherein the internal surface of said oblique holes is made a rough surface.

7. A main jet for use in a carburetor having an intake pass, an axially moveable throttle valve for forming a variable venturi in said intake pass, a main nozzle disposed at said intake pass and having a channel therein extending in an axial direction between said intake pass and a lower end, a jet needle having a longitudinal portion disposed between a head at one end and a base at the other end, said base being mounted to and moveable by said throttle valve, said longitudinal portion comprising a taper portion gradually decreasing in diameter toward said head and having said tapering and head portion inserted into said main nozzle channel said main jet being fixedly disposed at said main nozzle lower end and having an axial channel contiguous with said main nozzle channel, the lower end of said main jet fixedly provided on said main nozzle comprising a conical surface and a planar surface, said surfaces defining a truncated cone, a plurality of downwardly directed, oblique holes being formed in said conical surface and extending to said main axial channel for fuel-communication therewith.

8. The main jet as set forth in claim 7, wherein said holes are equally spaced on the circumference at an inclined angle 30° to 90° to said axial direction.

9. The main jet as set forth in claim 7, wherein the internal surface of said oblique holes is made a rough surface.

10. The main jet as set forth in claim 7, further comprising an upward oblique hole in fuel-communication with said axial channel.

* * * * *